United States Patent [19]

Hoffman

[11] 4,298,847

[45] Nov. 3, 1981

[54] MULTIPOSITION MICROWAVE SWITCH WITH INDEPENDENT TERMINATION

[75] Inventor: Jerzy Hoffman, Santa Monica, Calif.

[73] Assignee: Dynatech - UZ, Inc., Culver City, Calif.

[21] Appl. No.: 142,095

[22] Filed: Apr. 21, 1980

[51] Int. Cl.[3] ..... H01P 1/12

[52] U.S. Cl. ..... 333/105; 200/153 S; 335/5

[58] Field of Search ..... 333/105, 262; 335/5; 200/153 S

[56] References Cited

U.S. PATENT DOCUMENTS 2,958,054 10/1960 Concelman ..... 333/105

4,070,637 1/1978 Assal et al. ..... 333/105

*Primary Examiner*—Paul L. Gensler

[57] ABSTRACT

A multiposition microwave switch with a cavity comprising a center and a plurality of radial portions with acutely extended legs. The central coaxial connector selectively communicates with one of a plurality of peripheral connectors, the others being terminated by impedance matching resistors housed in the legs and isolated and shielded from the central connector. The cavity is housed beneath a plurality of pivotal rockers responsive to magnetic actuating means. First and second conductive reeds are spring loaded in the radial portions and legs, respectively, of the cavity and are mechanically responsive to the rockers such that when a first reed is conducting between central and peripheral connectors, its complimentary second reed is shorted to the housing. When the first reed is shorted to the housing, its complimentary second reed terminates the peripheral connector by conducting between it and the resistor.

3 Claims, 18 Drawing Figures

Fig. 1.
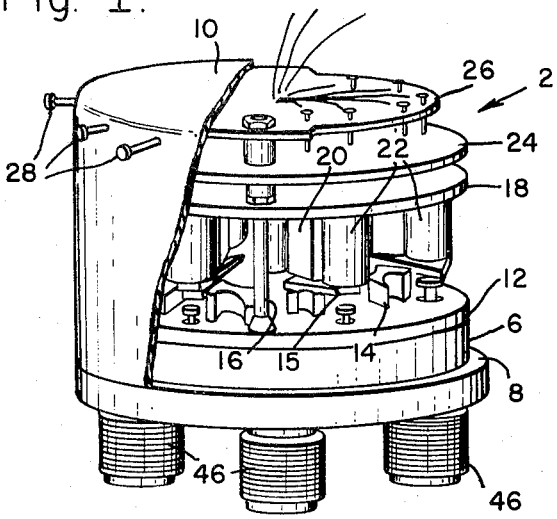
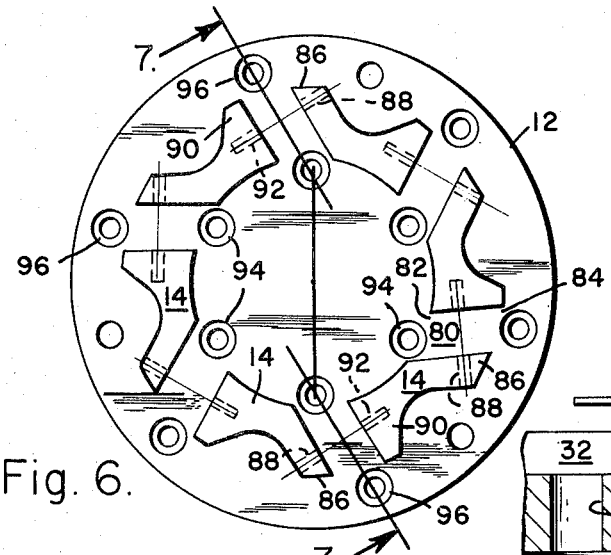
Fig. 6.
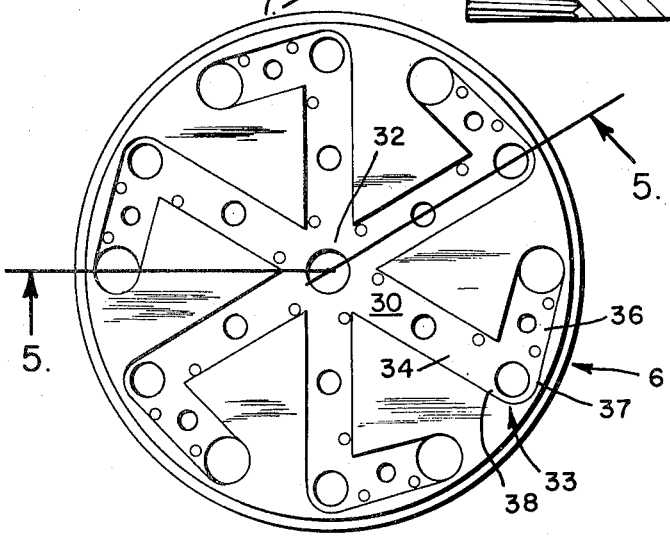
Fig. 2.
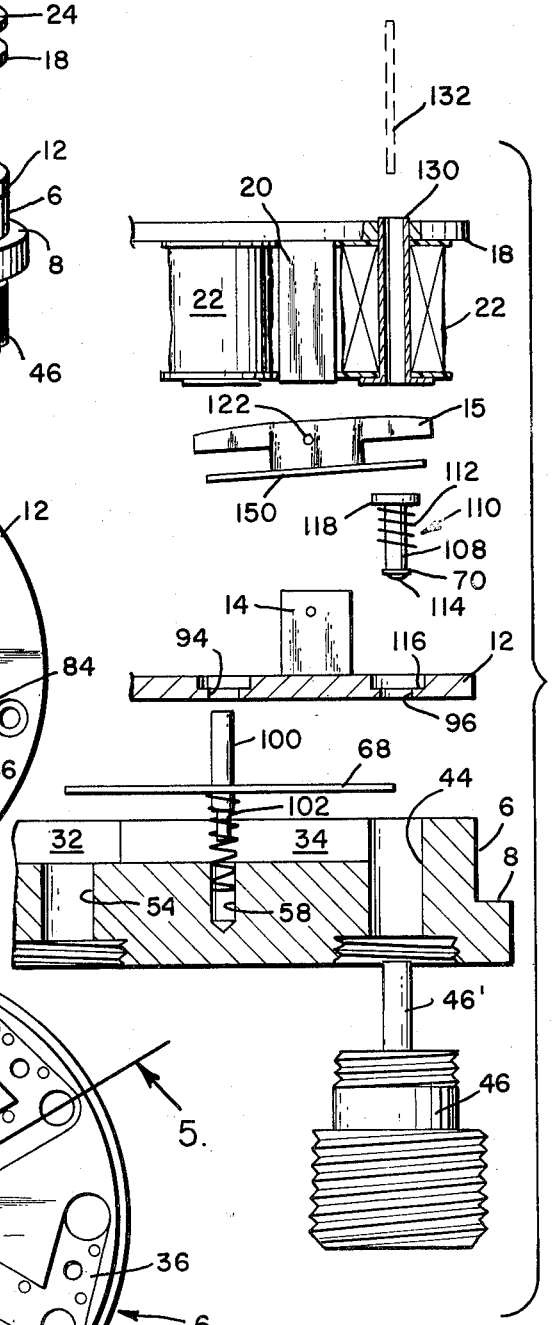
Fig. 8.

Fig. 9b.
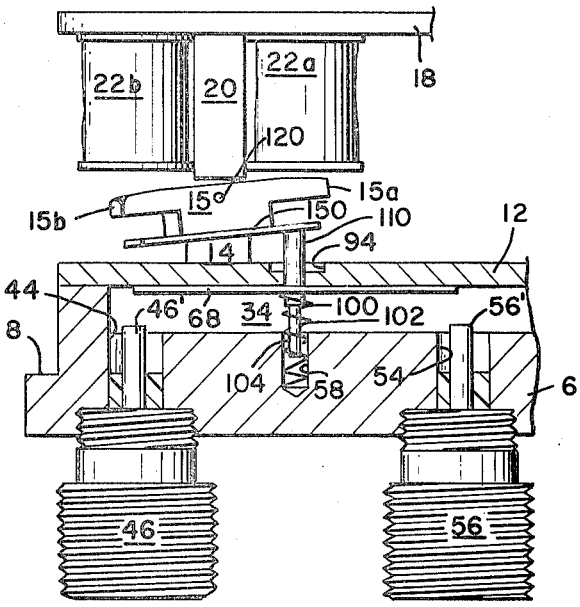
Fig. 10a.
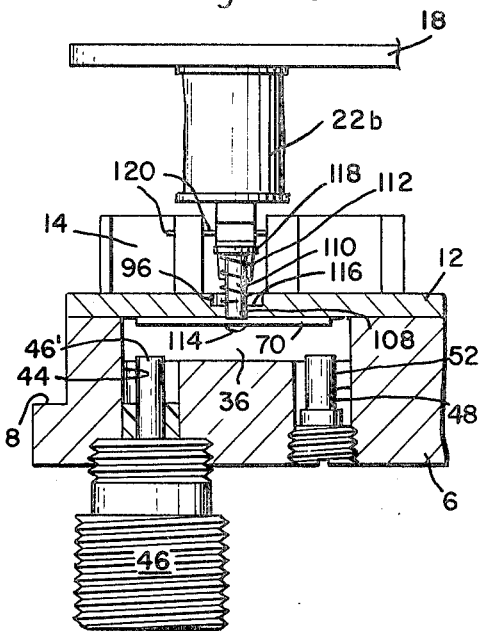
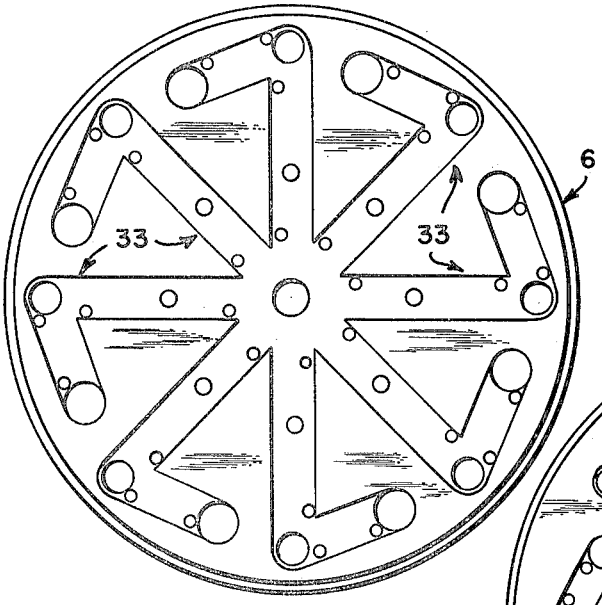
Fig. 2a.
Fig. 2b.
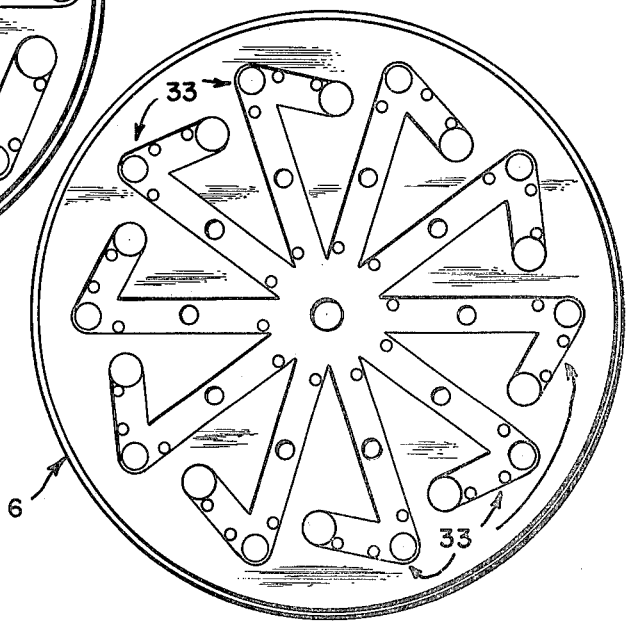

Fig. 7.
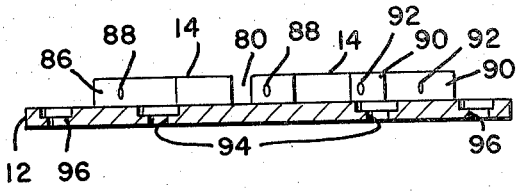
Fig. 5.
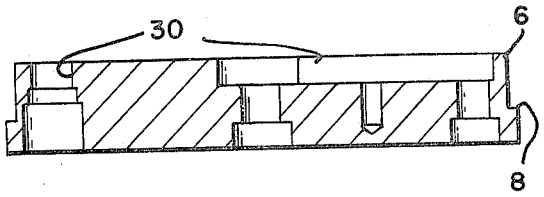
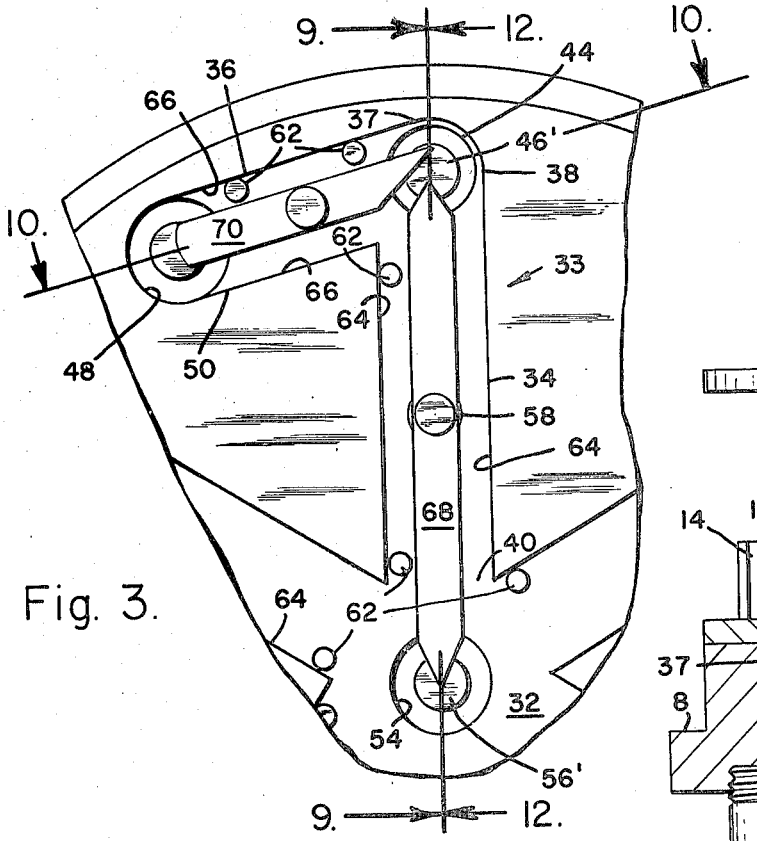
Fig. 3.
Fig. 10b.
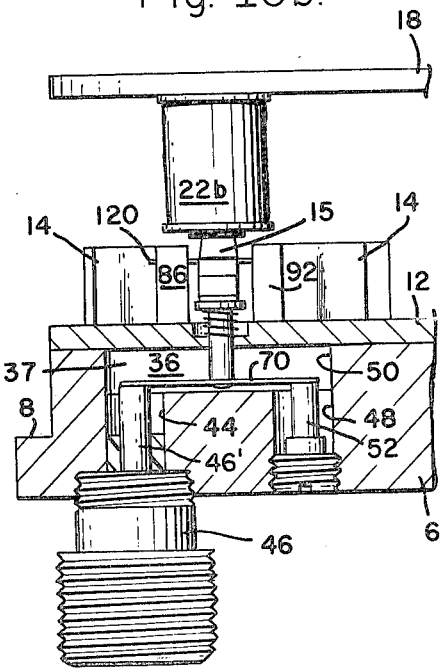
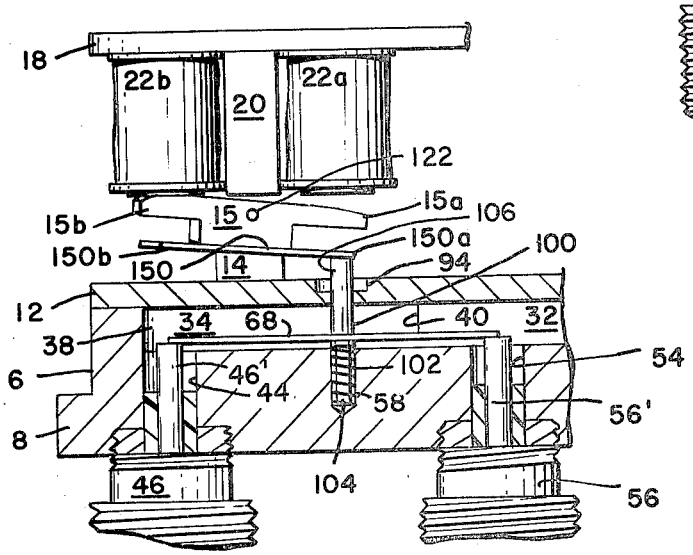
Fig. 9a.

MULTIPOSITION MICROWAVE SWITCH WITH INDEPENDENT TERMINATION

BACKGROUND OF THE INVENTION

1. Field of the Invention

This invention relates to microwave devices, and more particularly to electromechanical multiposition coaxial switches with angularly spaced radial channels and internal termination.

2. Description of the Prior Art

Pertinent prior art pertaining to the present invention is described in U.S. Pat. No. 3,182,270 by Russell E. Horton entitled "Multiple Position Coaxial Switch With Angularly Spaced Radial Channels." Therein Horton recites a central cylindrical cavity 12 with a contact disc 22 therein mounted on the inner conductor 16 of a central coaxial connector 14, and a plurality of termination resistors 31 above and in close unshielded proximity to the cavity 12. He further recites a plurality of cantilevered reeds 23 fixed to and extending from inner conductors 17 of peripheral connectors 15 to the disc 22. The resistors are designed to terminate the peripheral connectors with an impedance match when in contact with the reeds. Horton also recites a series of relay activated leaf springs whose pressure is used to break the termination.

At least two problems present themselves from such a configuration: reliability and isolation. The reliability of the switch will depend on how long the reeds will last before they break at their fixed position on the peripheral connectors, and/or how long the leaf springs will last. The reeds and leaf springs, after all, constitute cantilevered springs as shown, and bear tension at their fixed points. The problem of isolation arises from the close unshielded proximity of the termination resistors to the central connector.

The general state of the art, apart from the present invention, provides switches with 8 positions or less, a frequency range from DC to essentially 3 gigahertz (ghz), a maximum VSWR (voltage standing wave ratio) of essentially 1.6:1 or higher, an isolation of essentially 30 DB or less, and an overall outer diameter of greater than essentially 3½ inches.

The present invention improves significantly on these various parameters by a novel arrangement of features and parts and extends the state of the art significantly as further discussed below.

SUMMARY OF THE INVENTION

In view of the foregoing factors and conditions characteristic of the prior art, it is a primary object of the present invention to provide a new and improved multiposition microwave switch.

Another object of the present invention is to provide a reliable multiposition microwave switch devoid of cantilevered springs.

Still another object of the present invention is to provide a multiposition microwave switch having identical termination impedances associated with each position and isolated from one another and from the input terminal.

Yet another object of the present invention is to provide a multiposition microwave switch that can operate at frequencies up to approximately 18 ghz with a maximum VSWR as low as 1.1 to 1 and no more than essentially 1.5:1.

Still a further object of the present invention is to provide a multiposition microwave switch as aforesaid whose overall outer diameter is no greater than essentially 3 inches and provides isolation of at least 60 DB.

In accordance with one embodiment of the present invention a multiposition microwave switch is provided comprising a cylindrical metallic housing having a base and a cover plate with a cavity of uniform height disposed therein, the cavity comprising a central portion, and a plurality of spaced radial portions of uniform width extending radially therefrom, each said radial portion having an associated leg shorter and of equal width extending acutely from a peripheral end thereof; a central coaxial connector of predetermined characteristic impedance mounted in the base with its inner conductor extending into and coaxially with the central portion; a plurality of peripheral coaxial connectors equal in number to the plurality of radial portions, each peripheral connector having a characteristic impedance equal to that of the central connector and being mounted in the base parallel to said central connector with its inner conductor extending into the peripheral end of one of the radial portions, at the juncture thereof with one end of the leg; a plurality of termination resistors equal in number to the plurality of peripheral connectors, each resistor having an impedance equal to the characteristic impedance of the central connector and being mounted in the base and extending into the other end of the leg; a plurality of first conductors, equal in number to the plurality of peripheral connectors, each switchably disposed in one of the radial portions and of a length sufficient to connect the inner conductor of the central connector to the inner conductor of the peripheral connector when in a first of two switchable positions, and biased to be grounded when in the second of the switchable positions; a plurality of second conductors, equal in number to the plurality of peripheral connectors, each associated with one of the first conductors and disposed in one of the associated legs and of a length sufficient to connect the resistor to the inner conductor of the peripheral connector when in a complimentary first of two complimentary switchable positions, and biased to be grounded when in the complimentary second of the complimentary switchable positions; and actuating means disposed above the housing for selectively switching the first conductors between the two switchable positions and the second conductor between the two complimentary switchable positions, each first conductor being in its first position when its associated second conductor is in its complimentary second position, and in its second position when its associated second conductor is in its complimentary first position. The actuating means may be a pair of coils with a permanent magnet therebetween, and a rocker assembly mechanically arranged to alternately move the first and second conductors to their respective switchable positions in response to the magnetization of the coils. Alternately, a solenoid and biasing spring may be used to move the rocker as current is provided to and removed from the solenoid.

The features of the present invention which are believed to be novel are set forth with particularity in the appended claims. The present invention, both as to its organization and manner of operation, together with further objects and advantages thereof, may best be understood by making reference to the following description, taken in conjunction with the accompanying drawing in which like reference characters refer to like elements in the several views.

BRIEF DESCRIPTION OF THE DRAWINGS

FIG. 1 is a perspective view of one embodiment of the present invention with a portion of the cover removed;

FIG. 2 is a plan view of the base of the switch of FIG. 1 showing the cavity;

FIG. 2*a* is a plan view of the base of an 8-position switch according to one embodiment of this invention;

FIG. 2*b* is a plan view of the base of a 10-position switch according to one embodiment of this invention;

FIG. 3 is a blow up of part of the base of FIG. 2 showing the central portion and one of the radial portions with its associated leg in greater detail;

FIG. 5 is a cross-sectional elevational view of the base of FIG. 2 taken along section 5—5;

FIG. 6 is a plan view of the cover plate of FIG. 1;

FIG. 7 is a cross-sectional elevational view of the cover plate of FIG. 6 taken along section 7—7;

FIG. 8 is an exploded partially cross-sectioned elevational view of a representative section of the embodiment of FIG. 1;

FIGS. 9*a* and 9*b* are cross-sectional elevational views of the radial portion of FIG. 3 taken along section 9—9 and showing the first conductor in alternative switched positions;

FIGS. 10*a* and 10*b* are cross-sectional elevational views of the leg of FIG. 3 taken along section 10—10 and showing the second conductor in alternative switched positions corresponding, respectively, to FIGS. 9*a* and 9*b;*

DESCRIPTION OF THE PREFERRED EMBODIMENTS

Figure 4:
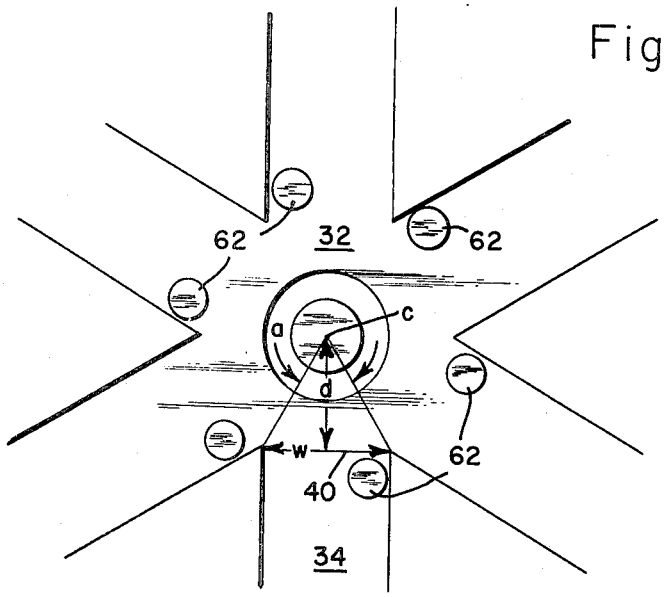
FIG. 4 is a further blow up of the central portion of FIG. 3.

Referring now to the drawings and more particularly to FIG. 1 there is shown a multiposition coaxial microwave switch 2 comprising a base 6, with a shoulder 8 to accomodate a cover 10. A first cover plate 12, seated on and covering the base 6, comprises a plurality of pivot pin mounts 14 which support pivotal rockers 15 further described below in greater detail in conjunction with FIGS. 6, 7, 8 and 10. The base 6 and first plate 12 comprise a housing for a cavity as further discussed below.

A series of posts 16 for holding additional plates are secured to the base 6. A second plate 18 is mounted on the posts 16 and has secured thereto a plurality of permanent magnets 20 and associated pairs of coils 22 which are used to activate the rockers 15 as further discussed below in greater detail. Third and fourth plates 24 and 26, respectively, mounted on the posts above second plate 18, provide suitable means for mounting circuitry, or visual readout displays as desired. Terminals 28 for access to said circuitry may also be disposed on the cover 10.

The base 6 is shown in plan view in FIG. 2 wherein can be seen the aforementioned cavity 30 which consists of a central portion 32, and a plurality of uniformly spaced radial L-sections 33 each comprising a radial portion 34 and an associated leg 36 with one end 37 joining said radial portion 34 at a peripheral end 38 thereof, and extending acutely therefrom. This acute extension allows the overall diameter of the switch to be determined primarily by the length of the radial portion 34 only, rather than by the sum of the radial portion 34 and the leg 36 if the leg were a longitudinal extension of the radial portion. FIG. 2 shows a plurality of six L-sections 33. FIGS. 2*a* and 2*b* also depict the base 6 of the present invention for a multiposition switch having eight and ten sections 33, respectively.

A blow-up of a typical L-section 33 and the central portion 32 is shown in FIG. 3. The cavity 30 is of uniform height, as can be seen from the elevational view of FIG. 5. The central portion 32 is a regular polygonal prism. The sides of the polygon are comprised of the inner ends 40 of the radial portions 34. Thus, the central portion 32 of FIG. 2 is a hexagonal prism, of FIG. 2*a* an octagonal prism, and of FIG. 2*b* a decagonal prism.

The central portion 32 of FIG. 3 is shown blown up in FIG. 4, with its size defined by the perpendicular distance 'd' from the center 'c' of the central portion 32 to the inner end 40 of the radial portion 34 whose width is 'w.' The distance $d=(w/2)$ cotangent $(a/2)$ where the angle 'a' is subtended from the width 'w' of the inner end 40 to the center 'c.' The angle 'a' is equal to 360° divided by the number of uniformly spaced L-sections.

The base 6 is preferably a single cylindrical piece of electrically conductive metal such as aluminum or brass, machined and plated with electroless nickel to produce the aforesaid cavity 30. It is also preferable to have an even number of L-sections 33 in order to simplify the machining process, although an odd number is also anticipated. The locations of the L-sections need not be along uniformly spaced radii of the base 6 as in FIG. 2, regardless of the number. They may be along radii spaced at different multiples of a given angle, or at randomly spaced radii. When they are spaced randomly, however, the central portion of the cavity will not be a regular polygon.

The L-section 33 has a first hole 44 at the peripheral end 38 of the radial portion 34 to accomodate a peripheral coaxial connector 46 seen in FIG. 1 and in greater detail in FIG. 8. A second hole 48 is disposed in the leg 36 at its other end 50 to accomodate a termination resistor 52 as shown in FIGS. 10*a* and 10*b*. A center hole 54 is disposed in and coaxially with the center of said central portion 32 to accomodate a central coaxial connector 56 as seen in FIGS. 9*a* and 9*b*. The characteristic impedance of each of the connectors 46, the connector 56, and the termination resistor 52 is the same, and preferably either fifty ohms or seventy-five ohms. By positioning the resistors 52 away from the central connector 56 as shown, a relatively higher degree of isolation between signals appearing at the various coaxial connectors is achieved.

The coaxial connectors 46 and 56 of the L-section 33 have inner conductors 46' and 56', respectively, which extend up into the cavity 30. A base guide hole 58 is disposed in the radial portion 34, and guide posts 62 are disposed along the walls 64 and 66 of the section 33. A first conductive reed 68 disposed in the radial portion 34, and an associated second conductive reed 70, disposed in the leg 36, are restrained from touching the walls 64 and 66, respectively, by the posts 62. The guide hole 58 and the reeds 68 and 70 are further discussed below.

The circularly distributed pivot pin mounts 14 of FIGS. 6 and 7 are of uniform size and spacing and are equal in number to the L-sections 33 of the base 6. Each successive pair of mounts 14 form a pivot channel 80 with an inner end 82 and an outer end 84, thereby providing as many pivot channels 80 as there are mounts 14. Each mount 14 has a front 86 with a first pivot hole 88 therethrough, and a rear 90 with a second pivot hole 92 therein. Thus the front 86 of one mount 14 and the rear 90 of the next successive mount 14 form a pair of supports for a pivot pin 120 (seen in detail in FIG. 10*a*) about which the rocker 15 pivots. Each channel 80 has an inner guide hole 94 disposed in the cover plate 12 near the inner end 82 and an outer guide hole 96 near the outer end 84. The significance of holes 94 and 96 is discussed below.

The plate 12 is preferably a single piece of electrically conductive metal such as aluminum or brass either cast or machined and plated with electroless nickel to produce the aforesaid mounts 14. Other mechanical means for pivotally mounting the rocker in the pivot channels, such as pairs of parallel support members welded to a metal disc and having pin holes for receiving the pivot pins is also satisfactory.

The assembly of the various parts of the invention is better understood by reference to FIG. 8 in conjunction with FIGS. 9*a*, 9*b*, 10*a* and 10*b*. The first reed 68, preferably of a highly conductive material such as gold plated beryllium-copper, is secured to an insulating guide member 100 and is vertically biased upward by a first spring 102 which is disposed about the lower end 104 of the member 100 and is seated in the guide hole 58 below the reed 68. The upper end 106 of the member 100 is guided and laterally constrained by the guide hole 94. The second reed 70, also preferably of gold plated beryllium-copper, is spring-loaded to the plate 12 as shown more particularly in FIG. 10*a*, as follows: The shank 108 of a rivet shaped insulating member 110 is disposed through a second spring 112 and then through the guide hole 96 of the plate 12. The end 114 of the shank 108 protrudes beyond the guide hole 96 and is secured to the reed 70, preferably in the fashion of a rivet. The guide hole 96 has a wider upper portion which provides an annular seat 116 for the spring 112 which is further constrained by the flathead 118 of the member 110. The member 110 is thus vertically biased upward by the spring 112.

It is to be understood that the spring loading method shown used on reed 68 could be used as well on reed 70, and that shown used on reed 70, on reed 68. In either spring loading method the reeds 68 and/or 70 are biased upward against the plate 12.

The magnet 20 and the two coils 22*a* and 22*b* associated therewith are secured to and extend down from the plate 18. The rocker 15, which comprises a shock absorbing leaf 150 secured thereunderneath, is pivotally mounted in the pivot channel 80 on a pivot pin 120 which is disposed in a pivot hole 122 in the rocker 15 and which is seated at either end by the first and second pivot holes 88 and 92, respectively, of the pair of successive pivot pin mounts 14. The plate 18 is arranged in relation to the plate 12 so that the complimentary pair of coils 22*a* and 22*b* are directly above the ends 15*a* and 15*b* of the rocker 15, respectively. The plate 12 is arranged in relation to the base 6 so that each guide hole 58 of base 6 is coaxially aligned with one of the inner guide holes 94 of plate 12.

The coils 22 are activated as desired by conventional circuit and power means so that when coil 22*b* of one pair of coils 22 has a temporary magnetic field which attracts end 15*b* of one rocker 15, its complimentary coil 22*a* is deactivated so as not to attract end 15*a* of the rocker 15. This situation is shown in FIG. 9*a* wherein the rocker 15 is seen pivoted so that end 150*a* of the leaf 150 pushes the member 100 into the guide hole 58, causing the reed 68 to contact the conductors 46′ and 56′, thereby providing a conducting path therebetween. With the rocker 15 in the aforesaid position in FIG. 9*a*, the complimentary condition of FIG. 10*a* prevails. In FIG. 10*a* the member 110 is in its vertically biased position and the reed is shorted against the plate 12. This provides enhanced isolation.

When the coil 22*a* has a magnetic field which attracts end 15*a* of the rocker 15, coil 22*b* is deactivated so that end 150*b* of the leaf 150 pushes down on the member 110, causing the reed 70 to contact the conductor 46′ and the resistor 52, thereby providing a conducting path therebetween. When this condition prevails, as shown in FIG. 10*b*, the condition of FIG. 9*b* also prevails. In FIG. 9*b* the member 100 is shown in its vertically biased position and the reed 68 is shorted against the plate 12, further enhancing the isolation. Switching is provided by alternating the magnetic field from coil 22*a* to 22*b* and back. Thus, when the reed 68 is switched to its conducting position as in FIG. 9*a* the reed 70 is switched simultaneously to its complimentary shorted position as in FIG. 10*a*, and when reed 68 is in its shorted position as in FIG. 9*b* reed 70 is in its complimentary conducting position as in FIG. 10*b*.

As the switching takes place the rocker 15 is snapped from one position to the other, causing one end to hit the magnetized coil while the other end hits the member (100 or 110) under the other coil. The leaf 150 is provided to absorb the shock of the rocker hitting the member.

It is to be understood that each L-section 33 portion of the cavity 30 has associated therewith a rocker 15, and a pair of coils 22, and comprises one of the positions of the multiposition switch. Each position can function as an independent communication channel whereby a signal input at the center conductor 56′ appears as an output signal at one of the peripheral conductors 46′, or one of the input signals at the various peripheral connectors 46′ appears as an output signal at the center conductor 56′, whichever the user desires. A position of the switch is considered 'on' when its first reed 68 is conducting between its center conductor 56′ and its peripheral conductor 46′, and 'off' when it is not.

An optional feature of this embodiment is provided by the fact that the core 130 about which the coil 22 is wound may be hollow centrally therethrough to accomodate a rod 132 which would be responsive to the rocker 15. This would permit the user to trigger a display on plate 26, for example, if desired.

Figure 12:
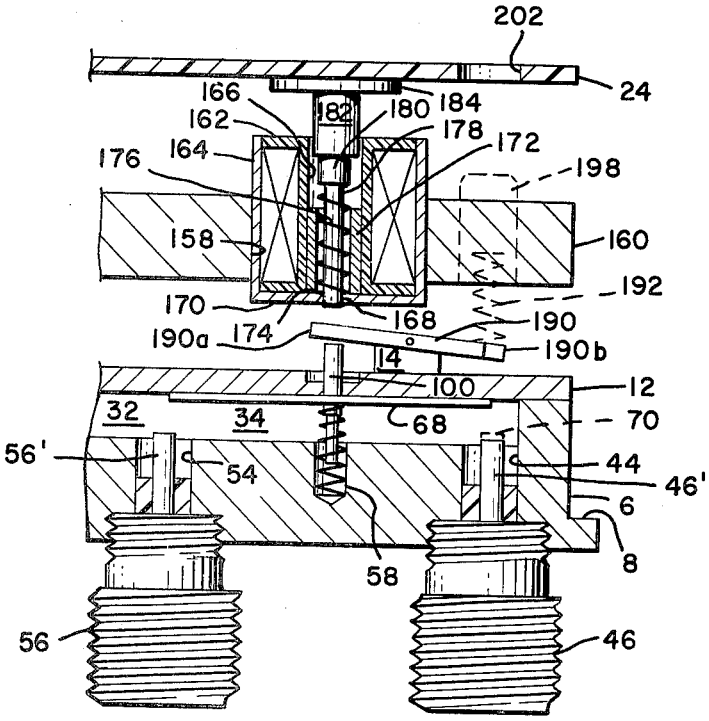
FIG. 12 is a cross-sectional elevational view of the section of the alternative embodiment of FIG. 11 taken along section 12—12 of FIG. 3.
Figure 11:
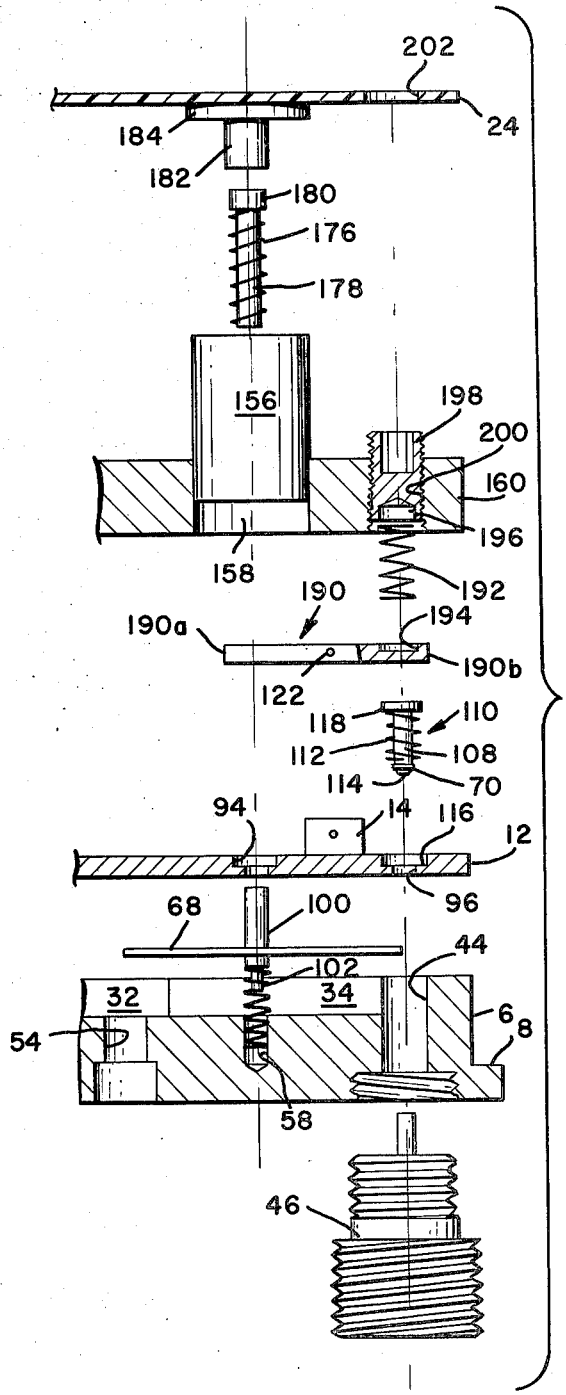
FIG. 11 is an exploded partially cross-sectioned elevational view of a representative section of an alternative embodiment of the present invention showing the solenoid and biasing spring in relation to the rocker.

Another preferred embodiment of the present invention is shown in FIGS. 11 and 12. Therein is shown a solenoid 156 secured in a hole 158 in a mounting plate 160 and comprising a wire wound bobbin 162 encased in a housing 164. The bobbin 162 is hollow longitudinally to define a shaft 166 therethrough. The housing 164 has a hole 168 in the bottom 170 thereof. Within the lower portion of the shaft 166 is a hollow cylinder 172 whose inner diameter is greater than that of the hole 168. The annular portion of the bottom 170 extending from the hole 168 to the cylinder 172 defines an annular lip 174. Within the cylinder 172 is a spring 176 seated on the lip 174 and having a plunger 178 disposed therein. The plunger 178 terminates in a plunger head 180 which fits within the cylinder 172 and restrains the spring 176. The plunger 178 is vertically biased upwardly thereby. Above the plunger head 180 is an armature 182 which terminates in a flathead 184 and which depresses the plunger 178 through the hole 168 when the solenoid 156 is magnetized. In this position the armature 182 and plunger 178 are restrained by the top of the member 100. When the solenoid 156 is not magnetized the armature 182 is biased upward by the plunger 178. The head 184 of the armature 182 is then restrained by the third plate 24.

The solenoid 156 is positioned in the plate 160 so that the plunger 178 is directly above an inner end 190*a* of an alternate rocker 190. When the plunger 178 is depressed, the end 190*a* of the rocker 190 is thereby also depressed and forces the member 100 down so that the reed 68 connects the conductors 46' and 56', as in FIG. 9*a*.

The rocker 190 is normally biased in the position shown in FIG. 12 by a rocker spring 192 which is seated below in an annular recess 194 in an outer end 190*b* of the rocker 190, and above in another annular recess 196 in a set screw 198 which is screwably positioned in a threaded hole 200 in the plate 160 and is adjustable through hole 202 in plate 24.

The rocker 190 is mounted on cover plate 12 in the same manner as rocker 15 in FIGS. 9 and 10. The plate 12, the base 6 and the reed 68 are also the same. Accordingly it will be understood that when the rocker 190 is in its normally biased position as in FIG. 12, the reed 70, not actually seen in the cross-section of FIG. 12, but depicted in end view in a dashed fashion for clarity nevertheless, will be terminating the peripheral conductor 46' to the termination resistor 52 (not seen or shown in FIG. 12), as in the case of FIG. 10*b*. In this embodiment switching is achieved by activating and deactivating the solenoid 156 by a conventional power source.

Desirable performances are achieved with a typical switch according to the present invention having the following dimensions: width 'w' of the radial portions and legs=0.172"±0.005"; height 'h' of the cavity=0.100"±0.005"; spacing between termination resistor of one L-section and the next L-section=0.020"; length 'l' of the radial portion measured from central inner conductor to peripheral inner conductor=0.830"±0.005" for a six-position switch, 0.980"±0.005" for an eight-position switch, and 1.210"±0.005" for a ten-position switch. Desirable performances are also achieved by the aforesaid switch with the following alternate combinations of the aforesaid height 'h' and width 'w': w=0.156"±0.005" and h=0.060"±0.005"; w=0.172"±0.005" and h=0.070"±0.005"; w=0.250"±0.005" and h=0.100"±0.005".

Performances achieved by switches taught by the present invention and having the aforesaid combination of dimensions are given in the following table.

TABLE OF PERFORMANCE

| # of Switch Positions | Frequency Range (in ghz) | Maximum VSWR | Minimum Isolation (in DB) | Maximum Insertion Loss (in DB) |
|---|---|---|---|---|
| 3 to 6 | 0–3 | 1.1–1 | 100 | .1 |
| | 3–8 | 1.2–1 | 80 | .15 |
| | 8–12.4 | 1.35–1 | 60 | .3 |
| | 12.4–18 | 1.5–1 | 60 | .5 |
| 7 or 8 | 0–3 | 1.1–1 | 100 | .1 |
| | 3–8 | 1.2–1 | 80 | .15 |
| | 8–12.4 | 1.35–1 | 60 | .3 |
| | 12.4–15 | 1.5–1 | 60 | .5 |
| 9 or 10 | 0–3 | 1.1–1 | 100 | .1 |
| | 3–8 | 1.2–1 | 80 | .15 |
| | 8–11.5 | 1.35–1 | 60 | .4 |

When the length 'l' varies by ±0.100" for the six- or eight-position switches and by ±0.200" for the ten-position switches, or when the width 'w' and height 'h' vary by ±0.015", the performances deteriorate by no more than approximately 5%. For greater tolerances on these dimensions the deterioration becomes geometrically greater.

Figure 13:
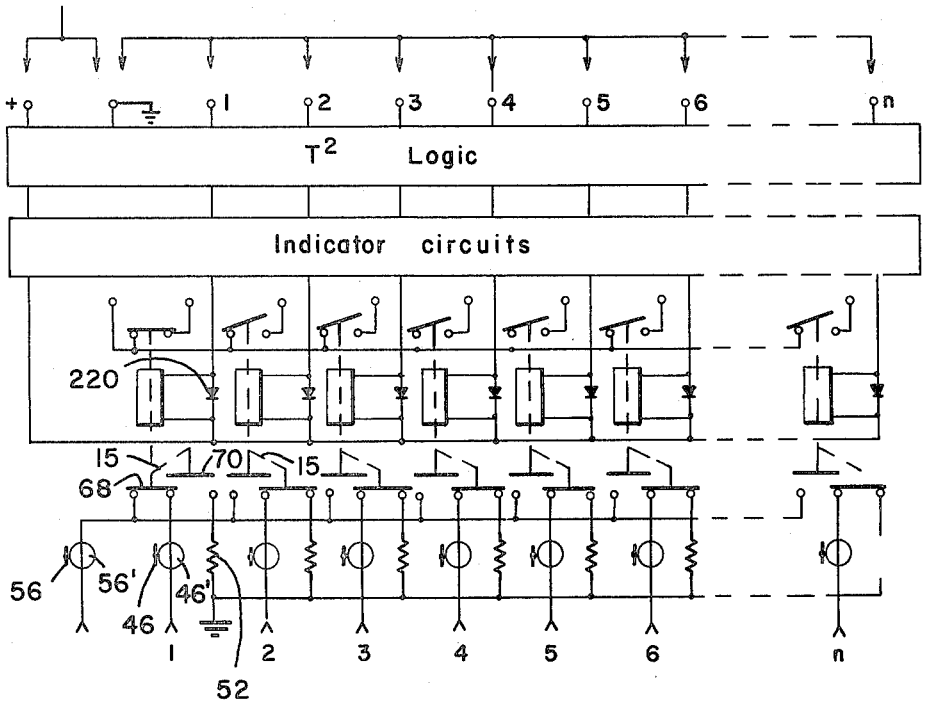
FIG. 13 is a schematic representation of the electrical connections of the embodiment of FIG. 1.
Figure 14:
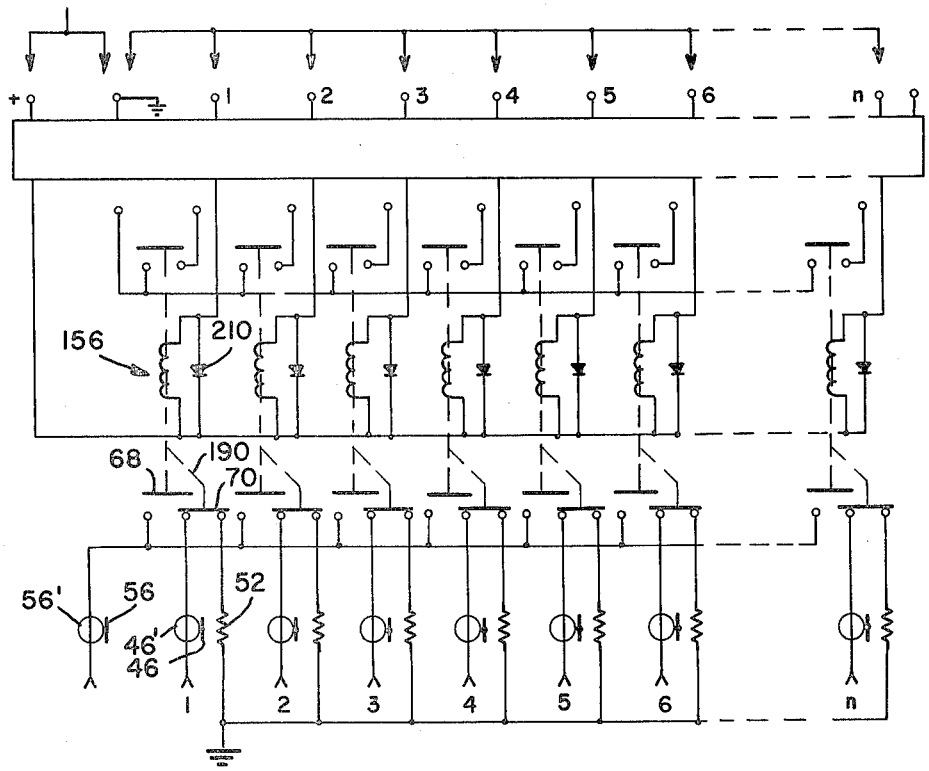
FIG. 14 is a schematic representation of the electrical connections of the embodiment of FIG. 11.

Conventional schematic representations of the activating mechanisms of the preferred embodiments are shown for completeness. FIG. 13 corresponds to the embodiment of FIG. 8, and FIG. 14 to that of FIG. 11. The items shown numbered therein are the schematic representations of the like numbered parts of the other drawings. Accordingly, in FIG. 13, when current flows in the diode 220 of the first switch position the end of rocker 15 is attracted to its associated coil, and the first switch position is switched 'on.' Similarly, in FIG. 14, when current flows in the diode 210 of the first switch position the plunger 178 is forced downward to depress the inner end 190*a* of the rocker 190, and the first switch position is switched 'on.'

For the embodiment of FIGS. 8 and 13 the maximum operating current required is minimized to 60 milliamps (at 28 volts and 72° F.) multiplied by the number of switch positions. For the embodiment of FIGS. 11 and 14 the maximum operating current required at (28 volts and 72° F.) is only 140 milliamps.

From the foregoing it should be evident that there has been described a new and advantageous multiposition microwave switch with independent termination that exhibits a relatively low maximum VSWR across a broad spectrum of microwave frequencies with relatively low insertion loss, relatively low current and a relatively high degree of isolation.

It should also be understood that the materials and processes described in fabricating the invention are not critical and any material and process exhibiting similar desirable characteristics and structures may be utilized. Further, it should be clear that changes, modifications and other embodiments which are obvious to persons skilled in the art to which the invention pertains are deemed to lie within the spirit, scope and contemplation of the invention.

What is claimed is:

1. A multiposition microwave switch comprising:

(a) an essentially cylindrical metallic housing having a base and a cover plate with a cavity of uniform height disposed therein, said cavity comprising a central portion and a plurality of spaced radial portions of uniform width extending radially therefrom, each said radial portion having an associated leg shorter and of essentially equal uniform width extending acutely from a peripheral end thereof;

(b) a central coaxial connector of predetermined characteristic impedance mounted in said base with its inner conductor extending into and coaxially with said central portion;

(c) a plurality of peripheral coaxial connectors equal in number to no more than said plurality of radial portions, each said peripheral connector having a characteristic impedance equal to that of said central connector and being mounted in said base parallel to said central connector with its inner conductor extending into said peripheral end of one of said radial portions, at the juncture thereof with one end of said leg.

(d) a plurality of termination resistors equal in number to said plurality of peripheral connectors, each said resistor having an impedance equal to the characteristic impedance of said central connector and being mounted in said base and extending into the other end of said leg;

(e) a plurality of first conductors, equal in number to said plurality of peripheral connectors, each switchably disposed in one of said radial portions and of a length sufficient to connect said inner conductor of said central connector to said inner conductor of said peripheral connector when in a first of two switchable positions, and biased to be grounded when in the second of said switchable positions;

(f) a plurality of second conductors, equal in number to said plurality of peripheral connectors, each associated with one of said first conductors and disposed in one of said associated legs and of a length sufficient to connect said resistor to said inner conductor of said peripheral connector when in a complimentary first of two complimentary switchable positions, and biased to be grounded when in the complimentary second of said complimentary switchable positions;

(g) actuating means disposed above said housing for selectively switching said first conductors between said two switchable positions and said second conductors between said two complimentary switchable positions, each said first conductor being in its said first position when its associated said second conductor is in its said complimentary second position, and in its said second position when its associated said second conductor is in its said complimentary first position.

2. The switch claimed in claim 1 wherein:

said actuating means comprises a pivotal rocker mounted on said housing and mechanically responsive to a magnetic actuating device; and said first and second conductors are respectively secured on first and second rigid vertically spring biased members respectively mechanically responsive to alternate ends of said rocker.

3. The switch claimed in claim 1 wherein:

said central portion defines a regular polygonal prism whose sides are equal in number to and defined by the inner ends of said plurality of radial portions; and the perpendicular distance from the center of said central portion to any one of said sides is equal to the product of half the width of said side and the cotangent of half the angle subtended by said side to said center.

* * * * *